US008490237B2

(12) United States Patent
Ross

(10) Patent No.: US 8,490,237 B2
(45) Date of Patent: Jul. 23, 2013

(54) COMBINATION STICKY ROLLER AND BRUSH

(75) Inventor: Tylor Christian Ross, Edwardsburg, MI (US)

(73) Assignee: Telebrands Corp., Fairfield, NJ (US)

( * ) Notice: Subject to any disclaimer, the term of this patent is extended or adjusted under 35 U.S.C. 154(b) by 0 days.

(21) Appl. No.: 13/396,214

(22) Filed: Feb. 14, 2012

(65) Prior Publication Data

US 2012/0144606 A1 Jun. 14, 2012

Related U.S. Application Data

(63) Continuation of application No. 13/008,206, filed on Jan. 18, 2011.

(60) Provisional application No. 61/372,692, filed on Aug. 11, 2010.

(51) Int. Cl.
*A47L 25/00* (2006.01)

(52) U.S. Cl.
USPC ..... 15/114; 15/106; 15/104.002

(58) Field of Classification Search
USPC ..... 15/104.002, 104.001, 187, 105, 106, 15/114, 159.1, 160, 188
See application file for complete search history.

(56) References Cited

U.S. PATENT DOCUMENTS

| | | | |
|---|---|---|---|
| 702,998 | A | 6/1902 | Randolph |
| 894,011 | A | 7/1908 | Kampfe |
| 1,827,003 | A | 10/1931 | Gailhofer |
| 2,065,584 | A | 12/1936 | Hempel |
| 2,534,086 | A | 12/1950 | Vosbikian |
| D165,753 | S | 1/1952 | Herron |
| 2,715,742 | A | 8/1955 | Coles |
| 2,895,152 | A | 7/1959 | Vosbikian |
| 2,935,754 | A | 5/1960 | Abdo |
| 3,148,398 | A | 9/1964 | Thomas |
| 3,158,887 | A | 12/1964 | Kanbar |
| D207,048 | S | 2/1967 | Pekar |
| 3,363,276 | A | 1/1968 | Thomas, Jr. |
| 3,398,418 | A | 8/1968 | Hans |
| 3,460,296 | A | 8/1969 | Dittmar |

(Continued)

FOREIGN PATENT DOCUMENTS

| | | | |
|---|---|---|---|
| CN | 201182695 | Y | 1/2009 |
| CN | 202341956 | U | 7/2012 |

(Continued)

OTHER PUBLICATIONS

Office Action mailed by the USPTO on Mar. 1, 2012 in commonly owned U.S. Appl. No. 13/163,275 (Applicant: Tylor Christian Ross).

(Continued)

*Primary Examiner* — Laura C Guidotti
(74) *Attorney, Agent, or Firm* — Cooper & Dunham LLP

(57) ABSTRACT

A combination brush and sticky roller apparatus used to clean a carpet or upholstery. The present invention comprises of a uniquely shaped bracket with a rubber brush and sticky roller. The rubber brush makes use of a plurality of rubber fingers that is able to reach into the deep layers of carpet or upholstery to dislodge and uproot dirt and debris. The uprooted dirt and debris are then accessible by the sticky roller to be collected and removed from the carpet or upholstery.

19 Claims, 8 Drawing Sheets

U.S. PATENT DOCUMENTS

| | | | | |
|---|---|---|---|---|
| 3,538,533 | A | 11/1970 | Woods | |
| D222,900 | S | 2/1972 | Derian | |
| 3,686,699 | A | 8/1972 | Knestele | |
| 3,742,547 | A | 7/1973 | Sohmer | |
| 3,744,082 | A | 7/1973 | Marshall | |
| 3,749,491 | A | 7/1973 | Maxfield | |
| 3,830,118 | A | 8/1974 | Holub, III | |
| 3,838,474 | A | 10/1974 | Erickson | |
| 3,906,578 | A | 9/1975 | Huber | |
| 4,381,157 | A * | 4/1983 | Brown | 401/21 |
| D282,604 | S | 2/1986 | Whitaker | |
| 4,703,538 | A | 11/1987 | Silverstrone | |
| 4,802,782 | A | 2/1989 | Scalf | |
| 4,979,257 | A | 12/1990 | Heneveld | |
| D313,509 | S | 1/1991 | Ueda | |
| D324,779 | S | 3/1992 | Ueda | |
| 5,153,254 | A | 10/1992 | Chen | |
| 5,162,858 | A | 11/1992 | Shoji | |
| D336,784 | S | 6/1993 | Yen | |
| 5,333,341 | A | 8/1994 | Heneveld | |
| D358,487 | S | 5/1995 | Kneesch et al. | |
| 5,533,223 | A | 7/1996 | Ho | |
| D382,408 | S | 8/1997 | Thielen | |
| 5,927,057 | A | 7/1999 | Hueber | |
| D485,075 | S | 1/2004 | Hutchinson | |
| 6,671,921 | B1 | 1/2004 | Hickman | |
| 7,020,926 | B2 | 4/2006 | McKay | |
| 7,065,822 | B1 | 6/2006 | Vandenburg | |
| 7,111,351 | B1 | 9/2006 | DeRoma | |
| 7,334,285 | B1 | 2/2008 | Morad et al. | |
| 7,377,001 | B2 | 5/2008 | McKay | |
| D572,868 | S | 7/2008 | McKay | |
| 7,621,234 | B2 | 11/2009 | Roy | |
| 7,624,469 | B2 | 12/2009 | Specht et al. | |
| 7,640,893 | B2 | 1/2010 | Woods | |
| D622,467 | S | 8/2010 | Martin | |
| 7,856,690 | B2 | 12/2010 | Tuman et al. | |
| D634,126 | S | 3/2011 | Viola | |
| 2004/0052570 | A1 * | 3/2004 | McKay | 401/219 |
| 2005/0183223 | A1 | 8/2005 | Cheng | |
| 2007/0192979 | A1 | 8/2007 | Knopow et al. | |
| 2009/0226657 | A1 | 9/2009 | Thiele | |
| 2012/0036660 | A1 | 2/2012 | Ross | |
| 2012/0036661 | A1 | 2/2012 | Ross | |
| 2012/0159726 | A1 | 6/2012 | Ross | |

FOREIGN PATENT DOCUMENTS

| | | |
|---|---|---|
| JP | 8143834 | 6/1996 |
| JP | 11019024 | 1/1999 |
| JP | 11299722 | 11/1999 |
| JP | 2008-279097 A | 11/2008 |

OTHER PUBLICATIONS

Office Action mailed by the USPTO on May 21, 2012 in commonly owned U.S. Appl. No. 13/413,370 (Applicant: Tylor Christian Ross).

Office Action mailed by the USPTO on Jun. 13, 2012 in related U.S. Appl. No. 13/008,206 (Applicant: Tylor Christian Ross).

* cited by examiner

COMBINATION STICKY ROLLER AND BRUSH

This application is a continuation of U.S. application Ser. No. 13/008,206 filed Jan. 18, 2011 which claimed priority to U.S. Provisional application Ser. No. 61/372,692 filed Aug. 11, 2010.

FIELD OF THE INVENTION

The present invention relates generally to a combination sticky roller and brush. More specifically, the present invention is used for collecting debris off the floor, upholstery, and clothing.

BACKGROUND OF THE INVENTION

Carpets and/or upholstery are made from natural or synthetic fibers being woven, knotted, tufted, or needle felt. With the carpets and/or upholstery being made from such fibrous materials, dirt and other debris are easily trapped within the fibers deep in the carpets and/or upholstery. Dirt and other debris can come with a large amount of different disease causing germs and bacteria. Although a user may be able to vacuum and have their carpets appear clean, an abundance of dirt and debris can still remain trapped within the deep layers of the carpet and/or upholstery. The dirt and debris that are trapped in the carpet and/or upholstery can originate from a large variety of sources. Such sources can include simple items such as shoes, personal bags or other personal items that are often brought into the outside environment and back into homes. The aggregation of dirt and debris inside carpets and/or upholstery can become a potential health hazard to users. If the dirt and debris remain in the carpet or upholstery for a prolonged period of time, they will eventually emit a foul odor that may cause the inside environment of a home unpleasant to stay in.

A large majority of American families typically wear their shoes into their own homes, dragging along the dirt and debris from the outside environment. The outside environment that families may have been include public bathrooms, public walkways, grocery stores, or any other places exposed to other people. Footwear walking into such places can easily pick up and retain the dirt and germs sourcing from those places as well. Without taking their shoes off while entering their own homes, disease causing bacteria and germs can easily be rubbed off onto the carpet or upholstery. Other items such as backpacks or purses are utilized by users to carry their personal belongings. However, many people do not pay attention to the areas they place their bags when setting it aside. Areas such as a counter where many people may have been in contact can have particles with an abundance of germs or bacteria. With the carpets or upholstery being exposed to such sources of Pet Hair, dirt and debris, users are required to clean their carpet or upholstery frequently to maintain a sanitary condition in their own homes.

The present invention introduces an apparatus that provides users with a means to easily clean their carpets or upholstery. The present invention is a combination brush and sticky roller device that includes a rubber brush that is able to reach deep within the carpets or upholstery layers to dislodge and uproot Pet Hair, dirt particle and debris to the surface. The Pet Hair, dirt and debris can then be picked up by a sticky roller. By removing the Pet Hair, dirt and debris from the carpets or upholstery, users are able to maintain a clean environment in their homes.

DETAIL DESCRIPTIONS OF THE INVENTION

Figure 1:
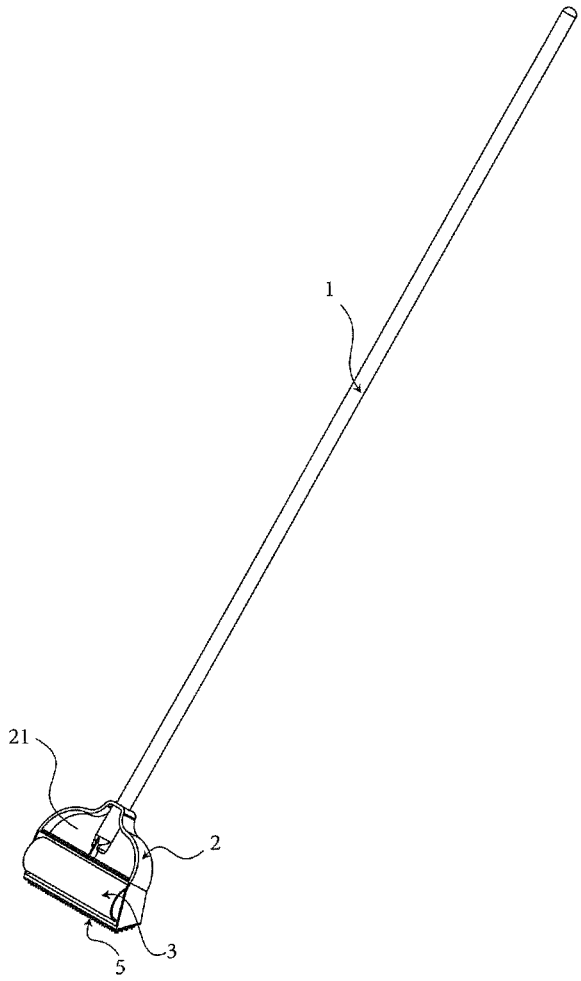
FIG. 1 is a perspective view of the present invention.

All illustrations of the drawings are for the purpose of describing selected versions of the present invention and are not intended to limit the scope of the present invention.

The present invention provides users the ability to dislodge and uproot pet hairs, dirt, and other debris from the layers deep within the carpet or upholstery. The uprooted pet hair, dirt, and debris are pulled to the surface of the carpet or upholstery where the user is able to pick up and retain the uprooted pet hair, dirt, and debris. In reference to FIG. 1 and FIG. 9, to provide the user with this ability, the present invention comprises of a pole handle 1, a bracket 2, a roller 3, a brush adhesive 4, and a rubber brush 5. The pole handle 1 is an elongated pole that connects to the bracket 2 providing the user the ability to handle the entire present invention. The length of the pole handle 1 allows users to handle the present invention at a distance away from the ground. This distance allows users reach the ground without having to strain their backs bending over. As a result, less stress is placed on a user's back during the carpet and upholstery cleaning process. The bracket 2 is the main body of the present invention that is able to hold all of the components together. The bracket 2 provides the roller 3 the ability to rotate while still being secured. Additionally, the bracket 2 is angled with a separate surface for the rubber brush 5. This prevents the roller 3 and the rubber brush 5 from interfering with each other's functionality. The purpose of the rubber brush 5 is to reach into the depth of the carpeting and upholstery layers to pull the lodged dirt and debris or tangled pet hair to the surface. The purpose of the roller 3 is to pick up and retain the pet hair, dirt, and debris to complete the cleaning process of the carpet and upholstery.

Figure 3:
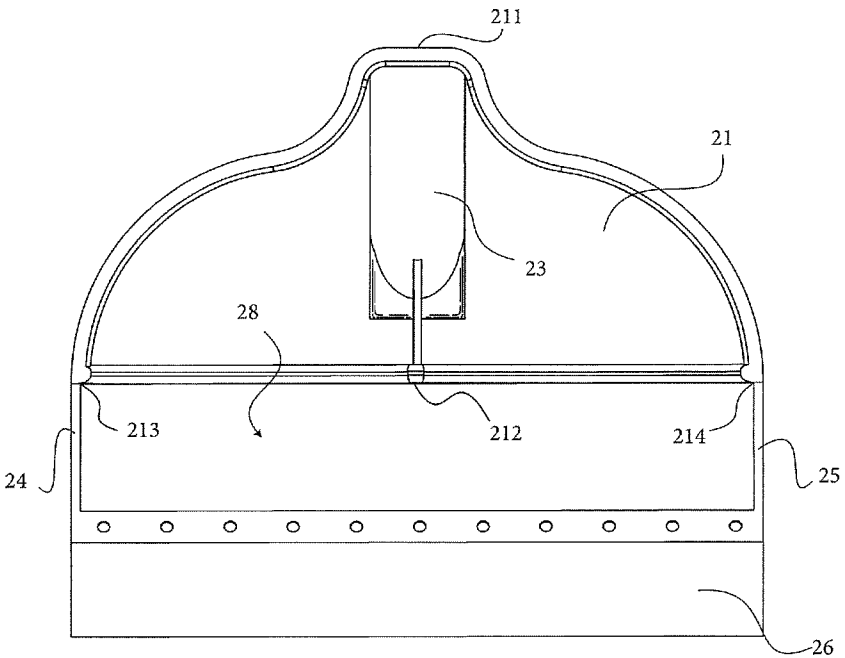
FIG. 3 is a rear view of the bracket of the present invention.
Figure 4:
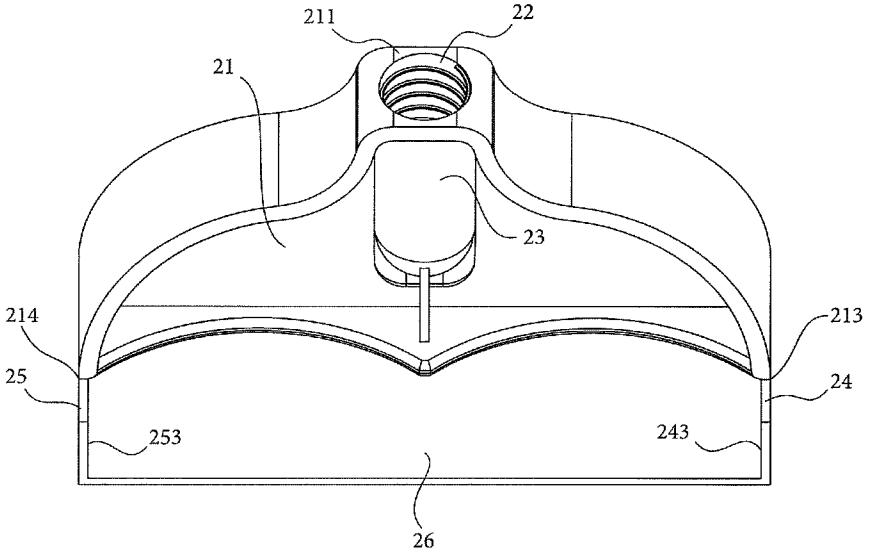
FIG. 4 is a top view of the bracket of the present invention.

In reference to FIG. 3-4, the bracket 2 is the main component of the present invention that holds the other components of the present invention together. The bracket 2 comprises of a bracket body 21, a threaded pole port 22, a pole receiving member 23, a first brush surface extender 24, a second brush surface extender 25, a brush surface 26, a pair of roller adapter holes 27 and a roller space 28. The bracket body 21 is the main body of the bracket 2 having a body upper side 211 and a body lower side 212. The bracket 2 can be manufactured to be any materials including wood, polymers, aluminum, or any other materials with the structural stability and stiffness to withstand stress and strain applied to the bracket 2 when the user is utilizing the other components to clean a carpet or upholstery. The body lower side 212 being wider and thicker than the body upper side 211 provides the bracket body 21 with a trapezoid like shape. In the preferred embodiment of the present invention, the bracket body 21 has a shape like a trapezoid with curved sides similar to a Reuleaux triangle with a flat base and a truncated top tip. Additionally, in the preferred embodiment of the present invention, the bracket body 21 is manufactured to have a recessed space on the front and the back surface. The bracket body 21 having recessed spaces will minimize the weight of the entire apparatus to provide the user with the ability easily handle the present invention. The pole receiving member 23 is cylindrically shaped and traverses through the bracket body 21 from the body upper surface towards the body lower surface. However, the pole receiving member 23 does not reach the body lower side 212 and tapers towards the center of the bracket body 21. The threaded pole port 22 is a recessed hole centered on the body upper side 211 leading into the pole receiving member 23. The threaded pole port 22 is defined by the walls of the pole receiving member 23. The body lower side 212 has a first side 213 and a second side 214. The first brush surface extender 24 and the second brush surface extender 25 protrude and extend from the first side 213 and the second side 214, respectively. The first brush surface extender 24 and the second brush surface extender 25 are flat pieces that are arranged parallel to the edges of the bracket body 21 defined by the first side 213 and the second side 214. The first brush surface extender 24 comprises of a first angled portion 241, a first extended portion 242 and a first roller side 243. The second brush surface extender 25 comprises of a second angled portion 251, a second extended portion 252, and a second roller side 253. The first angled portion 241 is the portion of the first brush surface extender 24 that initially protrudes from the first side 213. Likewise, the second angled portion 251 is the portion of the second brush surface extender 25 that initially protrudes from the second side 214. However, the first angled portion 241 and the second angled portion 251 protrude at an angle towards one side of the bracket body 21. The first extended portion 242 and the second extended portion 252 are the part of the brush surface extenders that extend in linear fashion. The first extended portion 242 is connected to the first side 213 by the first angled portion 241. The second extended portion 252 is connected to the second side 214 by the second angled portion 251. The first extended portion 242 and the second extended portion 252 are extended in an angled manner due to the angled portions. The first extended portion 242 and the second extended portion 252 are angled with respect to a first plane. The first plane is defined by being normal to the body lower side 212 and being parallel to the bracket body 21. The brush surface 26 of the bracket 2 is connected across the width of the bracket 2 directly to the first extended portion 242 and the second extended portion 252. The first angled portion 241 has a first arc center 241*a* and a first arc 241*b*. The second angled portion 251 has a second arc center 251*a* and a second arc 251*b*. The first roller side 243 is the side of the first brush surface extender 24 that is adjacent to the first arc 241*b*. The second roller side 253 is the side of the second brush surface extender 25 that is adjacent to the second arc 251*b*. The roller space 28 of the bracket 2 is the space defined by the body lower side 212, the first brush surface extender 24, the second brush surface extender 25, and the brush surface 26. The roller space 28 is the space on the bracket 2 that is provided to fit and hold the roller 3. To hold the roller 3, the pair of roller adapter holes 27 is positioned on the first brush surface extender 24 and the second brush surface extender 25. The pair of roller adapter holes 27 is recessed grooves that are positioned on the surface of the first brush surface extender 24 and the second brush surface extender 25 facing the towards the roller space 28. In the preferred embodiment of the present invention, a second plane is defined by being parallel to the body lower side 212 and a third plane is defined by being parallel to the brush surface 26. The third plane is angled at 30 to 45 degrees with respect to the second plane due to the angled portion of the brush surface extenders. The preferred angle of the first extended portion 242 and the second extended portion 252 is 30 to 45 degrees in relationship to the first plane.

Figure 5:
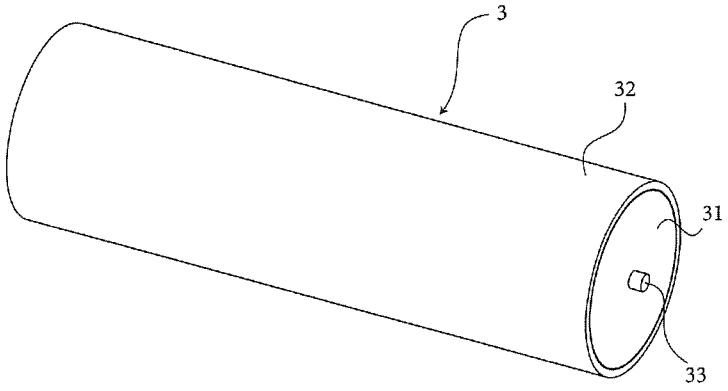
FIG. 5 is a perspective view of the roller of the present invention.
Figure 6:
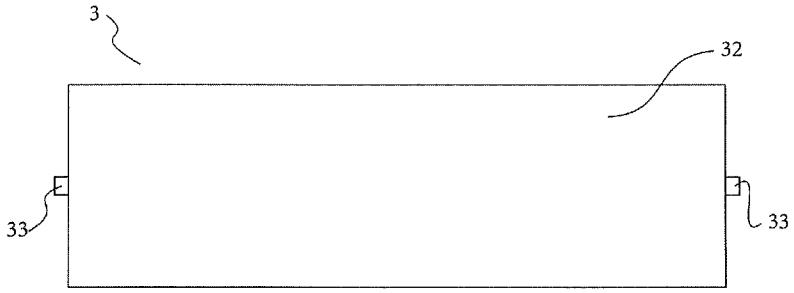
FIG. 6 is a front elevational view of the roller of the present invention.

In reference to FIG. 5-6, the roller 3 of the present invention is the component of the present invention responsible for picking up and retaining pet hairs, dirt, and debris on the surface of a carpet or upholstery. The roller 3 comprises of a core 31, a sticky layer 32, and a pair of pins 33. The core 31 is cylindrically shaped and provides the roller 3 the ability to roll. The core 31 is sized to have a radius and length to fit into the roller space 28 of the bracket 2. The core 31 can be made from any materials including plastics, metals, woods or any other suitable materials. In the preferred embodiment of the present invention, the core 31 is made from a plastic material. The sticky layer 32 is the component of the roller 3 that is able to pick up and retain pet hair, dirt, and debris. The sticky layer 32 is adhered to the circumferential area of the core 31. In the preferred embodiment of the present invention, the sticky layer 32 is made out of the material silicone rubber. Silicone rubber is a material with a very low glass transition temperature. The property of low glass transition temperature provides the silicone rubber with the ability to attract and remove foreign particles. The glass transition temperature is temperature that determines the phase transition that separates a material's two different states of matter. The silicone rubber's property of a low glass transition temperature provide it with a unique cross-linking polymer structure and is the reason that it is able to attract and retain pet hairs, dirt, and dust. The unique cross-linking structure of the silicone rubber also provides it a sticky layer on its surface. Although silicone is the material of the preferred embodiment of the present invention, the material for the sticky layer 32 can be any other suitable materials that provide adhesive capabilities for attracting and retaining pet hair, dirt, and debris. However, the material must be washable to restore stickiness. To secure the roller 3 to the bracket 2, the pair of pins 33 is positioned on and protrudes from the two ends of the core 31 in a concentric relationship. The pair of pins 33 is shaped and sized to fit into the pair of roller adapter holes 27. This ensures that the roller 3 is able to rotate smoothly while still being secured to the bracket 2.

Figure 7:
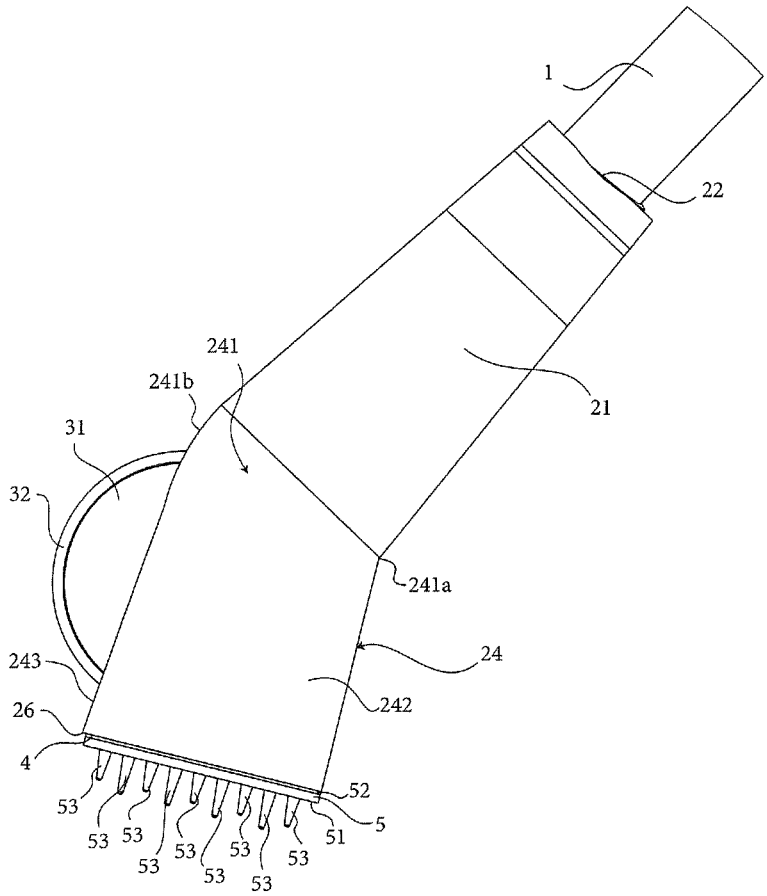
FIG. 7 is a close up right side elevational view of bracket assembly of the present invention holding all of the components together.
Figure 8:
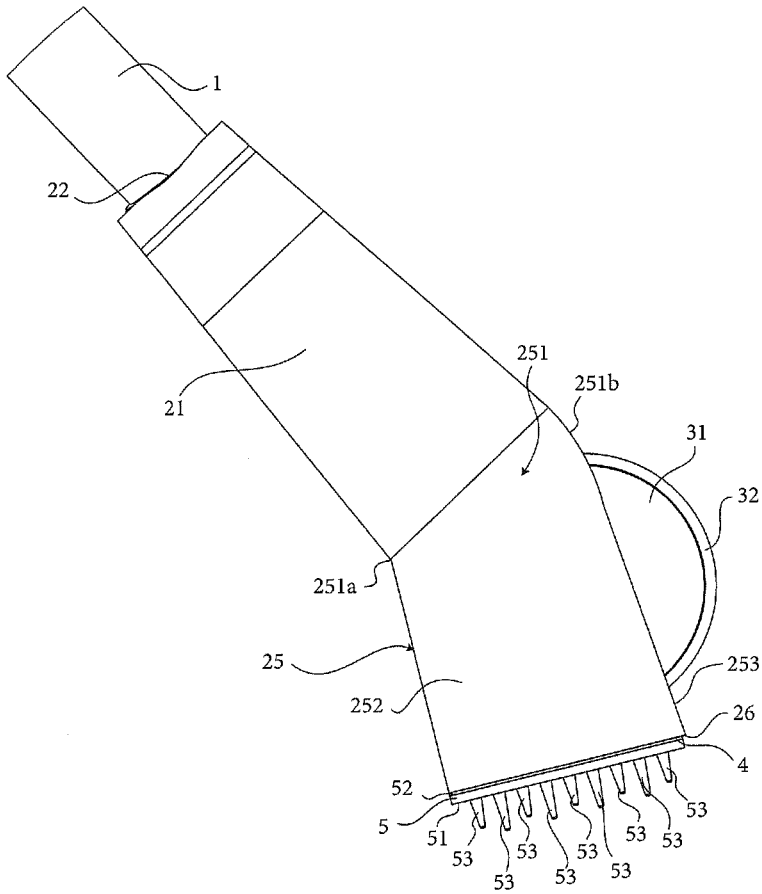
FIG. 8 is a close up left side elevational view of bracket assembly of the present invention holding all of the components together.
Figure 9:
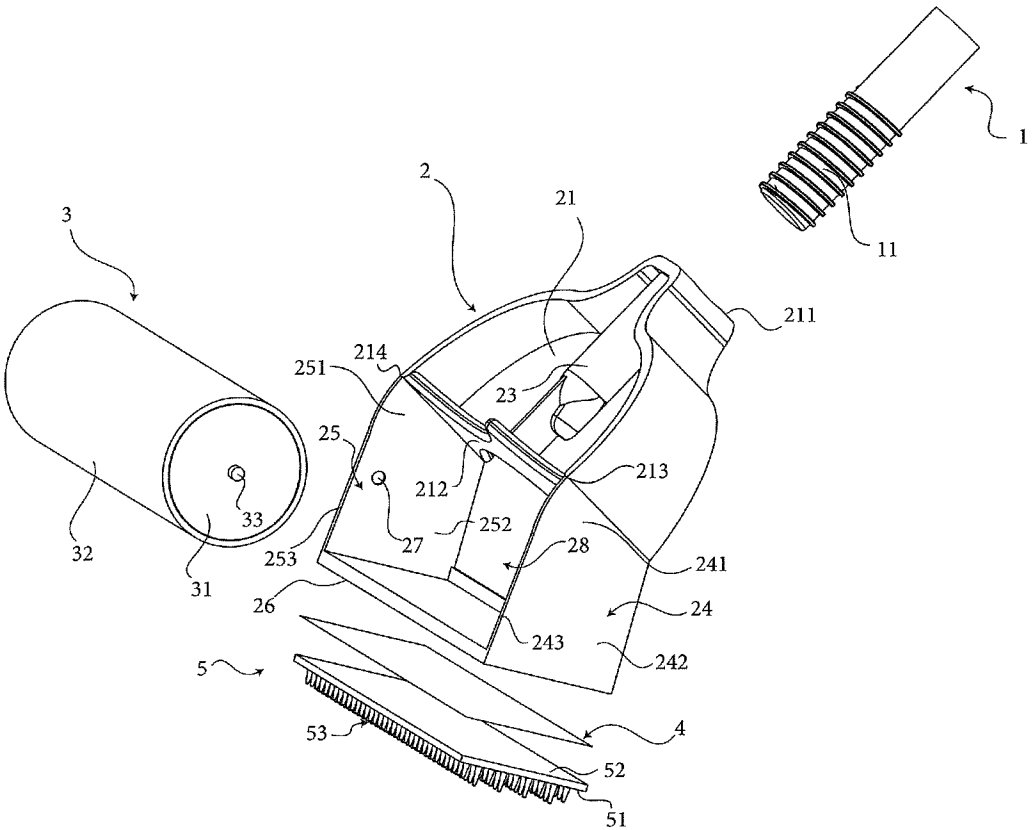
FIG. 9 is a close up explosion view of the assembly of the present invention.

In reference to FIG. 7-9, the rubber brush 5 is the component of the present invention that is responsible for reaching into the deep layers of the carpet or upholstery to dislodge and pull up pet hairs, dirt, and debris that are lodged into the fibers of the carpet or upholstery. The rubber brush 5 comprises of a finger side 51, a bracket side 52, and a plurality of finger members 53. In the preferred embodiment of the present invention, the rubber brush 5 is made from the material thermoplastic rubber. Similar to the sticky layer 32 of the roller 3, the thermoplastic rubber will help the rubber brush 5 attract and pull dust from the deeper layers of the carpet or upholstery. However, in other embodiments of the present invention, the rubber brush 5 can be made from any rubber materials capable of dislodging and removing pet hair, dirt, and debris particles from the deep layers of the carpet or upholstery. The rubber brush 5 is a rectangular piece that is shaped consistently with the brush surface 26. The bracket side 52 is the side of the rubber brush 5 that is adhered directly to the brush surface 26. The finger side 51 is the side of the rubber brush 5 where the plurality of finger members 53 protrudes from. The plurality of finger members 53 is protruding tips that can be any shape including rounded cones, rounded hooks, tetrahedrons, or any other shape capable of reaching into the deep layers of a carpet or upholstery. The plurality of finger members 53 protruding from the finger side 51 of the rubber brush 5 can be patterned in any way that can efficiently pull the maximum amount of pet hair, dirt, and debris from the carpet or upholstery layers. The plurality of finger members 53 can be patterned in a linear array fashion or a staggered fashion with different finger members varying in shapes and sizes. For example, the plurality of finger members 53 can be arranged in a linear array fashion with alternating rows of short tetrahedron and long rounded cones.

Figure 2:
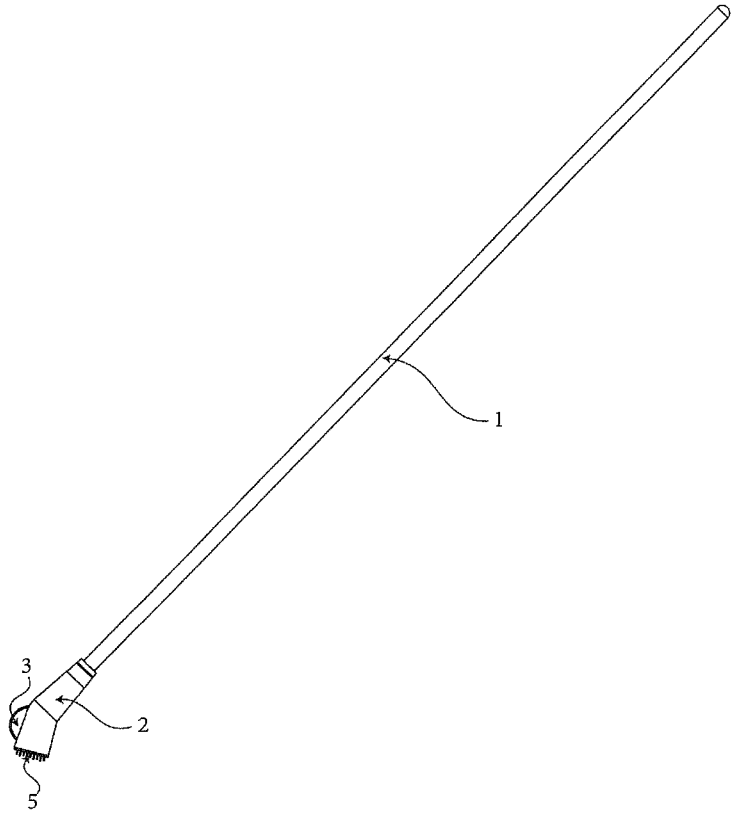
FIG. 2 is a right side elevational view of the present invention.

In reference to FIG. 1-2 and FIG. 9, the pole handle 1 is an elongated pole that provides users with a means of utilizing the present invention without having the bend down to the floor to remove pet hair, dirt, and debris from the carpet or upholstery. The pole handle 1 comprises of a threaded end 11 for connection to the bracket 2. The pole handle 1 allows the user to handle the entire assembly of the present invention. The pole handle 1 can be made from any materials including wood, aluminum, polymer plastics, or any other sturdy materials able to withstand stress and strain from usage. The pole handle 1 can also be made out of a combination of materials. For example, the manufacturer of the present invention can make the pole handle 1 to be a hollow aluminum pole with a polymer plastic outer coating. In other embodiments, the pole handle 1 can be manufactured to be plastic with a rubber coating on the outside to provide a soft grip allowing the user to easily maneuver and utilize the present invention.

In reference to FIG. 9, the apparatus of the present invention is assembled by the connection of the pole handle 1, the roller 3, and the rubber brush 5 to the bracket 2. The pole handle 1 is attached to the bracket 2 by means of fastening the threaded end 11 into the threaded pole port 22 positioned on the body upper side 211. The roller 3 is attached to the bracket 2 by means of the pair of pins 33 being inserted and secured to the pair of roller adapter holes 27. The pair of roller adapter holes 27 is positioned close to the roller sides of the brush surface extenders to allow a maximum amount the radius of the roller 3 to extend out from the bracket 2. To attach the rubber brush 5 to the brush surface 26, the brush adhesive 4 is first applied to the bracket side 52 of the rubber brush 5. Once the brush adhesive 4 is applied, the rubber brush 5 is then aligned and pressed against the brush surface 26. The brush adhesive 4 is a water resistant adhesive that is able to permanently bond the rubber brush 5 to the brush surface 26. With the brush adhesive 4 being water resistant, the user is able to wash the rubber brush 5 without having to worry about the rubber brush 5 disengaging from the bracket 2.

To use the present invention, the user will simply handle the apparatus by the pole handle 1. Handling the apparatus by the pole handle 1 the user is able to have the rubber brush 5 pressed against the carpet or upholstery allowing the plurality of finger members 53 to reach into the deeper layers of the carpet or upholstery. The user is able to then push and pull the pole handle 1 to drag the rubber brush 5 across a carpet or upholstery to release and remove pet hairs, dirt, and debris from the deep layers of the carpet or upholstery. Once all the pet hairs, dirt, and debris have been pulled to the surface of the carpet or upholstery, the user is able to flip the apparatus around with roller 3 contacting the ground. The angling of the brush surface extenders and the protrusion of the radius of the roller 3 allows the user to manipulate the pole handle 1 with a larger range of angles to continually remove pet hairs, dirt, and debris from the surface of the carpet or upholstery. During the process of cleaning the carpet or upholstery, pet hair and debris will collect and accumulate on the rubber brush 5 and the roller 3. The accumulated debris will slowly decreases the ability of the rubber brush 5 and the sticky layer 32 to attract and retain additional pet hair, dirt, and debris. To restore the ability of the rubber brush 5 and the sticky layer 32 to attract and retain pet hair, dirt, and debris, the user will have to wash the present invention with water. Water is able to release pet hairs, dirt, and debris from the rubber brush 5 and the sticky layer 32. With a clean rubber brush 5 and sticky layer 32, the user is able to resume the cleaning process.

Although the invention has been explained in relation to its preferred embodiment, it is to be understood that many other possible modifications and variations can be made without departing from the spirit and scope of the invention as hereinafter claimed.

What is claimed is:

1. A combination sticky roller and brush comprising, a bracket having a base portion and pair of spaced apart arms extending in the same direction from opposite ends of said base portion;

a roller mounted to said bracket between and rotationally supported by said spaced apart arms, said roller having a cylindrical core and a washable sticky layer defining a circumferential surface of said roller, said bracket base portion being spaced from said circumferential surface of said roller;

a bracket upper portion extending between the distal ends of said spaced apart arms, said bracket upper portion being radially offset in one direction from said circumferential surface of said roller;

a bracket brush portion extending from the spaced apart arms of said bracket and radially offset in a second direction from said circumferential surface of said roller, said brush portion having a plurality of rubber brush fingers along a length thereof extending outwardly away from said roller; and a handle removably affixed to said bracket.

2. The combination sticky roller and brush as claimed in claim 1 comprising a threaded port on said bracket upper portion, said handle being removably connected to the bracket by means of fastening a threaded end thereof into the threaded port.

3. The combination sticky roller and brush as claimed in claim 2 in which, said threaded port is cylindrically shaped and traverses at least a part of said bracket upper portion in said one direction.

4. The combination sticky roller and brush as claimed in claim 1 in which, said bracket base portion is wider than said bracket upper portion, each of said spaced apart arms has an angled portion, an extended portion, and a roller side of said angled portion, wherein said roller is rotationally supported between the roller sides of said angled portions of said spaced apart arms.

5. The combination sticky roller and brush as claimed in claim 4 in which the angled portion of each of said spaced apart arms forms an angle in the range of from approximately 30 to 45 degrees relative to the corresponding one of said extended portions of each of said spaced apart arms.

6. The combination sticky roller and brush as claimed in claim 1 in which, each of said rubber brush fingers comprises a protruding pip selected from the group of shapes consisting of rounded cones or rounded hooks and is made from Thermoplastic rubber.

7. The combination sticky roller and brush as claimed in claim 1 in which each of said rubber brush fingers is made of silicone rubber.

8. The combination sticky roller and brush as claimed in claim 1 in which said plurality of rubber brush fingers are arranged in a plurality of adjacent substantially parallel lines, each of said lines being substantially parallel to the rotational axis of said roller and substantially the same as the longitudinal length of said roller.

9. The combination sticky roller and brush as claimed in claim 8 in which the height of the rubber brush fingers defining any one line thereof is the same and is different from the height of the rubber brush fingers defining any adjacent line thereof.

10. A combination sticky roller and brush comprises, a pole handle;

a bracket;

a roller;

a rubber brush;

a brush adhesive;

the pole handle comprises of a threaded end;

the bracket comprises of a bracket body, a threaded pole port, a pole receiving member, a first brush surface extender, a second brush surface extender, a brush surface, and a roller space; the roller comprises of a core and a sticky layer;

the rubber brush comprises of a finger side, a bracket side, and a plurality of finger members;

the bracket body comprises of a body upper side and a body lower side;

the first brush surface extender comprises of a first angled portion, a first extended portion, and a first roller side;

the second brush surface extender comprises of a second angled portion, a second extended portion, and a second roller side;

the plurality of finger members being protruded in from the finger side;

the plurality of finger members being protruding pips selected from the group of shapes consisting of rounded cones or rounded hooks;

the rubber brush being made from the material Thermoplastic rubber;

the core being cylindrically shaped with two ends; and the sticky layer being adhered circumferentially to the core.

11. The combination sticky roller and brush as claimed in claim 10 comprises, the pole handle being connected to the bracket by means of fastening the threaded end into the threaded pole port;

the roller being rotationally attached to the bracket; and the rubber brush being adhered to the bracket.

12. The combination sticky roller and brush as claimed in claim 11 comprises, the bracket side being adhered to the brush surface by means of the brush adhesive.

13. The combination sticky roller and brush as claimed in claim 10 comprises, the body lower side being wider than the body upper side;

the body lower side having a first side and a second side;

the first angled portion being protruded from the first side the second angled portion being protruded from the second side;

the first extended portion being connected to the first side by the first angled portion; and the second extended portion being connected to the second side by the second angled portion.

14. The combination sticky roller and brush as claimed in claim 13 comprises, the pole receiving member being cylindrically shaped and traversing through the bracket body from the body upper side towards the body lower side; and the threaded pole port being a recessed hole on the body upper side leading into and being defined by the pole receiving member.

15. The combination sticky roller and brush as claimed in claim 13 comprises, a first plane being normal to the body lower side and being parallel to the bracket body;

the first extended portion being angled with respect to first plane by means of the first angled portion;

the second extended portion being angled with respect to the first plane by means of the second angled portion;

the brush surface being connected to the first extended portion and the second extended portion;

the first angled portion having a first arc center and a first arc;

the second angled portion having a second arc center and a second arc; the first roller side being adjacent to the first arc;

the second roller side being adjacent to the second arc;

the roller space being defined by the body lower side, the first brush surface extender, the second brush surface extender, and the brush surface; the second brush surface extender facing towards the roller space;

a second plane being parallel to the body lower side;

a third plane being parallel to the brush surface;

the third plane being at 30 to 45 degrees in relationship to the second plane; and the first extended portion and the second extended portion being at 30 to 45 degrees in relationship to the first plane.

16. A combination sticky roller and brush comprises, a pole handle;

a bracket;

a roller;

a rubber brush;

a brush adhesive;

the pole handle comprises of a threaded end;

the bracket comprises of a bracket body, a threaded pole port, a pole receiving member, a first brush surface extender, a second brush surface extender, a brush surface, and a roller space;

the roller comprises of a core and a sticky layer;

the rubber brush comprises of a finger side, a bracket side, and a plurality of finger members;

the bracket body comprises of a body upper side and a body lower side;

the first brush surface extender comprises of a first angled portion, a first extended portion, and a first roller side;

the second brush surface extender comprises of a second angled portion, a second extended portion, and a second roller side; the plurality of finger members being protruded in from the finger side;

the plurality of finger members being protruding pips selected from the group of shapes consisting of rounded cones or rounded hooks;

the rubber brush being made from the material Thermoplastic rubber;

the core being cylindrically shaped with two ends;

the sticky layer being adhered circumferentially to the core;

the pole handle being connected to the bracket by means of fastening the threaded end into the threaded pole port;

the roller being rotationally attached to the bracket; the rubber brush being adhered to the bracket; and the bracket side being adhered to the brush surface by means of the brush adhesive.

17. The combination sticky roller and brush as claimed in claim 16 comprises, the body lower side being wider than the body upper side;

the body lower side having a first side and a second side;

the first angled portion being protruded from the first side the second angled portion being protruded from the second side;

the first extended portion being connected to the first side by the first angled portion;

the second extended portion being connected to the second side by the second angled portion;

a first plane being normal to the body lower side and being parallel to the bracket body;

the first extended portion being angled with respect to first plane by means of the first angled portion;

the second extended portion being angled with respect to the first plane by means of the second angled portion; and the brush surface being connected to the first extended portion and the second extended portion.

18. The combination sticky roller and brush as claimed in claim 17 comprises, the pole receiving member being cylindrically shaped and traversing through the bracket body from the body upper side towards the body lower side; and the threaded pole port being a recessed hole on the body upper side leading into and being defined by the pole receiving member.

19. The combination sticky roller and brush as claimed in claim 17 comprises, the first angled portion having a first arc center and a first arc;

the second angled portion having a second arch arc center and a second arc;

the first roller side being adjacent to the first arc;

the second roller side being adjacent to the second arc;

the roller space being defined by the body lower side, the first brush surface extender, the second brush surface extender, and the brush surface; the second brush surface extender facing towards the roller space;

a second plane being parallel to the body lower side;

a third plane being parallel to the brush surface; the third plane being at 30 to 45 degrees in relationship to the second plane; and the first extended portion and the second extended portion being at 30 to 45 degrees in relationship to the first plane.

* * * * *